US005421887A

United States Patent [19]

Guddal

[11] Patent Number: 5,421,887

[45] Date of Patent: Jun. 6, 1995

[54] METHOD AND APPARATUS FOR APPLYING ADHESIVE TO SHEET INSULATION

[76] Inventor: Karl Guddal, 2839 NW. 64th, Seattle, Wash. 98107

[21] Appl. No.: 123,783

[22] Filed: Sep. 20, 1993

[51] Int. Cl.[6] ..... B05C 3/09; B05C 3/18; B05C 11/00

[52] U.S. Cl. ..... 118/686; 118/708; 118/102; 118/123; 118/407; 118/413; 118/415; 118/421; 118/426; 118/612; 118/236; 118/256

[58] Field of Search ..... 118/708, 686, 102, 123, 118/407, 413, 415, 426, 612, 207, 236, 237, 240, 241, 242, 256, 421; 198/718, 464.2; 414/797.9; 15/256.5; 271/35, 42

[56] References Cited

U.S. PATENT DOCUMENTS

| | | | |
|---|---|---|---|
| 371,155 | 10/1887 | Videto | 118/415 |
| 964,133 | 7/1910 | Strehler | 118/413 |
| 1,117,341 | 11/1914 | Cross | 118/415 |
| 1,792,788 | 2/1931 | Wilde et al. | 118/612 |
| 1,863,545 | 6/1932 | Raettig | 118/612 |
| 1,980,216 | 11/1934 | Merritt | 118/612 |
| 2,054,448 | 9/1936 | Russell | 118/413 |
| 2,066,780 | 1/1937 | Holt | 118/102 |
| 2,329,378 | 9/1943 | Kuehner | 118/413 |
| 2,345,937 | 4/1944 | Joa | 414/797.9 |
| 2,353,474 | 7/1944 | Kiehm | 414/797.9 |
| 2,374,659 | 5/1945 | Bassler | 198/718 |
| 2,439,040 | 4/1948 | Cohen | 414/797.9 |
| 2,570,379 | 10/1951 | Robinson | 118/413 |
| 2,588,874 | 3/1952 | Quick | 118/708 |
| 2,625,978 | 1/1953 | Patterson | 118/708 |
| 3,526,535 | 9/1970 | Plumat | 118/407 |
| 3,611,470 | 10/1971 | Gaston | 118/102 |
| 3,744,621 | 7/1973 | Adams et al. | 198/718 |
| 4,804,321 | 1/1989 | Rieggo | 118/415 |
| 5,115,907 | 5/1992 | Pomara, Jr. | 198/718 |

*Primary Examiner*—W. Gary Jones
*Assistant Examiner*—Steven P. Griffin
*Attorney, Agent, or Firm*—Lloyd L. Zickert; Adam H. Masia

[57] ABSTRACT

A method and apparatus for sequentially applying a predetermined amount of adhesive to a series of sheets of insulation having a frame with a conveyor mounted at one end, a magazine adapted to maintain and dispense sheets of insulation, one at a time onto the conveyor, a floating adhesive dispensing hopper is positioned adjacent to the conveyor, and a sheet stopping mechanism located on the other side of the hopper at the opposite end of the frame. In operation, a plurality of sheets of insulation are loaded into the magazine, dispensed onto the conveyor one at a time, then driven by the conveyer under the floating adhesive dispensing hopper which applies adhesive to the entire width of the sheet of insulation as the sheet passes under the hopper. The stopping mechanism beyond the hopper stops the movement of the sheet of insulation by deactivating the conveyor until the sheet with the adhesive applied thereon is removed.

29 Claims, 8 Drawing Sheets

METHOD AND APPARATUS FOR APPLYING ADHESIVE TO SHEET INSULATION

DESCRIPTION

This invention relates in general to a method and apparatus for applying adhesive to sheets of insulation, and more particularly to a method and apparatus for sequentially applying a predetermined amount of adhesive to a series of sheets of insulation one at a time, providing uniform application of the adhesive to each sheet and significantly reducing the amount of time and labor necessary for the application of the adhesive to the sheets of insulation.

BACKGROUND OF THE INVENTION

Heretofore, it has been well known in building construction to attach sheets of insulation or insulation board to an erected building, such as gypsum, concrete, or other masonry. The sheets of insulation are applied uniformly to the entire surface of the building for insulation purposes. An aesthetic, waterproof, and impact resistant finishing material or system is generally applied over the insulation. One example of such an application is the "THOROWALL" systems in which the insulation is an Expanded Poly-Styrofoam, commonly referred to as "EPS." "THOROWALL" is a trademark owned by Thoro System Products. Besides EPS, there are numerous types of sheet insulation material including different types of styrofoam available for use in building construction. The EPS sheets are generally light in weight, approximately one pound per cubic foot, and their dimensions vary, although a standard size is two feet wide by four feet long with a thickness of one, two, or more inches.

While mechanical fasteners have been used to attach the sheets of insulation to the substrate, a common method has been to apply adhesive or glue to the sheets of insulation to adhesively secure the insulation to an erected building substrate. Several types of adhesives are commercially available, some being more suitable to different substrates, different types of insulation, and differing climates. Also some adhesives may be mixed with cement.

Heretofore, adhesives have been manually applied to sheets of insulation using an assortment of tools such as trowels or caulking guns. The manual application of adhesive to multiple sheets of insulation is labor intensive and extremely time consuming. Moreover, manual application of the adhesive to the sheets of insulation tends to cause nonuniform coverage of the adhesive on the entire sheet. This tends to foster additional increases in the labor and time necessary for the proper securement of the insulation to the substrate. These problems are further magnified in colder climates where the construction season is considerably shorter than in warmer climates.

SUMMARY OF THE INVENTION

The present invention overcomes these problems in providing a method and apparatus for sequentially applying a predetermined amount of adhesive to a series of sheets of insulation, one at a time, providing uniform application of adhesive to each sheet and significantly reducing the amount of time and labor necessary for the application of the adhesive to the sheets. Consequently, the present invention significantly reduces the amount of time needed to secure the insulation to the building substrates.

The adhesive-applying apparatus of the present invention includes a portable horizontally extending frame having an inlet section, a central section, and an outlet section. The inlet section of the frame includes a power-driven conveyor for driving a sheet of insulation from the inlet section to the central section and a magazine positioned above the conveyor for holding and dispensing sheets of insulation, one at a time, onto the conveyor. The central section includes a floating adhesive dispensing hopper with a screed assembly for storing and for uniformly applying a predetermined amount of adhesive on the sheet of insulation as the sheet passes under the hopper. The outlet section includes a sheet-stopping assembly for temporarily deactivating the conveyor until the sheet with adhesive is removed from the outlet section of the frame.

To sequentially apply adhesive to a series of sheets of insulation using the apparatus and method of the present invention, several sheets of insulation are loaded into the magazine arranged over the conveyer on the inlet section. The magazine dispenses the lowermost sheet onto the conveyor, and the conveyor drives the sheet horizontally to the central section and under the floating hopper. As the sheet is driven under the hopper, an engaging member on the hopper contacts the sheet and directs the floating of the hopper above the sheet. The hopper has a lower opening substantially as wide as the sheet of insulation through which adhesive stored in the hopper is applied to the sheet of insulation as the sheet passes under the hopper. The hopper's screed assembly contains a series of teeth along its lower end which engage the sheet of insulation to uniformly spread a predetermined amount of adhesive on the sheet and prevent excess adhesive from remaining on the sheet as it passes from underneath the hopper.

As the sheet of insulation passes from under the hopper to the outlet section of the frame, it engages a stopping assembly provided on the outlet section. When the stopping assembly is engaged, the conveyer is stopped, thereby preventing the conveyer from driving the next sheet of insulation completely under the hopper and to the outlet section until the first sheet with the adhesive applied thereon is removed from the outlet section of the frame. Once the first sheet is removed, the stopping assembly reactivates the conveyor which drives the second sheet of insulation completely under the hopper and to the outlet section. By repeating this process, adhesive is efficiently applied to numerous sheets of insulation.

It is therefore an object of the present invention to provide an apparatus for sequentially applying a predetermined amount of adhesive to a series of sheets of insulation one at a time, providing uniform application of the adhesive to each sheet and significantly reducing the amount of time and labor necessary for the application of the adhesive to the sheets.

Another object of the present invention is to provide a mobile apparatus for applying adhesive to sheets of insulation which may be taken to and from various construction sites and to different locations on each construction site.

Another object of the present invention is to provide a method for sequentially applying a predetermined amount of adhesive to a series of sheets of insulation one at a time, providing uniform application of the adhesive to each sheet and significantly reducing the amount of time and labor necessary for the application of the adhesive to the sheets.

Other objects, features and advantages of the invention will be apparent from the following detailed disclosure, taken in conjunction with the accompanying sheet of drawings, wherein like reference numerals refer to like parts.

DESCRIPTION OF THE INVENTION

Figure 1:
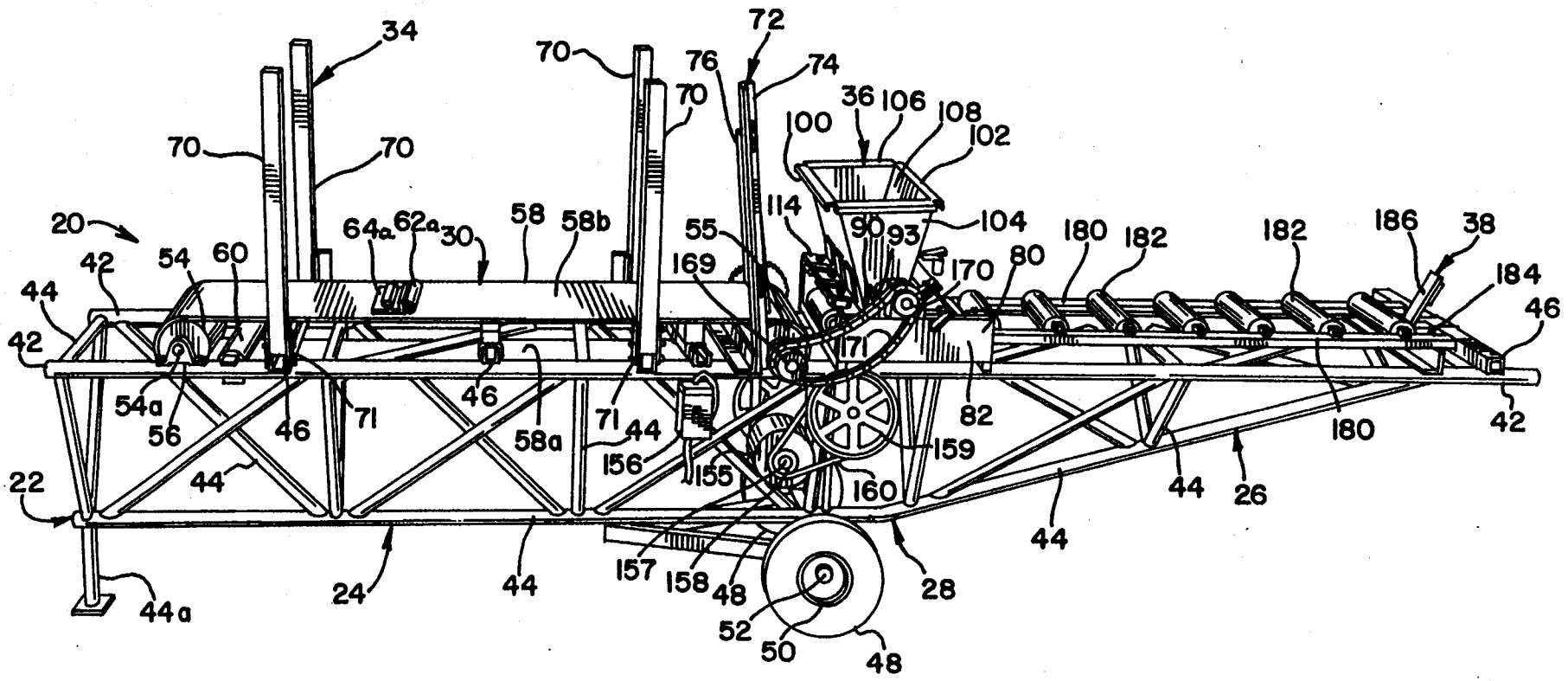
FIG. 1 is a side perspective view of the adhesive applying apparatus of the present invention.

Referring now to the drawings, and particularly to FIGS. 1 to 4, the adhesive-applying apparatus 20 of the present invention includes a horizontally extending frame 22 which, for explanatory purposes, is divided into three sections. One end of the frame 22 is referred to as an inlet section or end 24; the other end of the frame is referred to as an outlet section or end 26; and positioned between the inlet and outlet sections is a central section 28. The inlet section 24 generally includes a power driven conveyor 30 for driving a sheet of insulation 32 from the inlet section 24 to the central section 28 and a magazine 34 positioned above the conveyor 30 for holding and dispensing sheets of insulation, one at a time, onto the conveyor 30. The central section 28 generally includes a floating adhesive dispensing hopper or bin 36 for storing and applying a predetermined amount of adhesive onto the top surface of the sheet of insulation 32 as it is driven under the hopper 36. The outlet section 26 generally includes a roller conveyer having a sheet-stopping assembly 38 for deactivating the conveyor 30 until the sheet of insulation 32 with adhesive applied thereon is removed from the outlet section 26.

More specifically, the horizontally extending frame 22 includes a pair of parallel supports or bars 42 extending the entire length of the upper portion or bed of the frame. The supports 42 are supportably connected by a plurality of bracing members 44 and crossbars 46. The bracing members 44 are secured at the same level and below the supports 42, while the crossbars 46 are perpendicularly mounted across the top of the supports. The supports, bracing members, and crossbars are made from aluminum tubing and are welded together, although other well-known materials and methods of attachment could be employed. The present invention could be also constructed wherein the inlet, central, and outlet sections are detachable from each other or wherein they are separate units positioned adjacent to each other.

The frame 22 is centrally supported by a pair of suitable tires or wheels 48, wherein each tire is mounted on a rim 50 suitably connected to an axle 52 which in turn is mounted to the lower part of the frame at the junction of the inlet and central sections. Each axle is secured to the lower end of the frame in a conventional manner to enable the entire adhesive applying apparatus 20 to be maneuvered on the tires 48, thereby providing mobility and portability to the adhesive-applying apparatus. It is contemplated that the adhesive-applying apparatus of the present invention will be transported to and from different construction sites and possibly to various locations on each construction site.

In the stationary position, the bracing members 44 on the inlet section 24 assist the tires in supporting the adhesive-applying apparatus. One of the bracing members **44*a* extends downwardly from the supports and engages the ground to maintain the frame in a substantially horizontal position. To move the adhesive-applying apparatus, the inlet section 24 is lifted off the ground and the entire apparatus 20 is moved on the tires in like fashion to a wheelbarrow or cart having two tires. The bracing members 44 on the outlet section 26** do not engage the ground while the frame is in a substantially horizontal position to aid the lifting of the inlet section of the apparatus during movement. It should be appreciated that the inlet or outlet sections may be modified to have a tire assembly for supporting the frame and engaging the ground and that the entire frame assembly could be modified in accordance with the present invention.

As mentioned above, the inlet section 24 is equipped with a power driven conveyor 30 for driving a sheet of insulation 32 from the inlet section 24 to the central and outlet sections of the frame. The conveyor 30 includes an idle conveyor roller 54 and a power driven conveyor roller 55 mounted at substantially opposite ends of the inlet section 24, each roller having a shaft 54*a* and 55*a*, respectively, extending longitudinally at its central axis. The conveyor rollers are mounted in suitable bearings 56 which are mounted on the supports 42. Although either one or both conveyor rollers may be power driven, roller 55 is preferably power driven as more fully explained below.

A suitably sized conveyor belt 58 having inner and outer surfaces 58*a* and 58*b*, respectively, is trained about conveyor rollers 54 and 55 such that the belt's inner surface 58*a* frictionally engages the conveyor rollers. The conveyor rollers are appropriately spaced apart to ensure sufficient tension on the conveyor belt and can alternatively be attached to the supports using one or more conventional turnbuckles (not shown) for adjusting the rollers to increase or decrease the tension on the conveyor belt and/or adjust the orientation of the rollers. A stabilizing roller 60 may also be attached to the supports 42 between the conveyor rollers 54 and 55 for engaging and stabilizing the conveyor belt 58 in a well-known manner.

Figure 10:
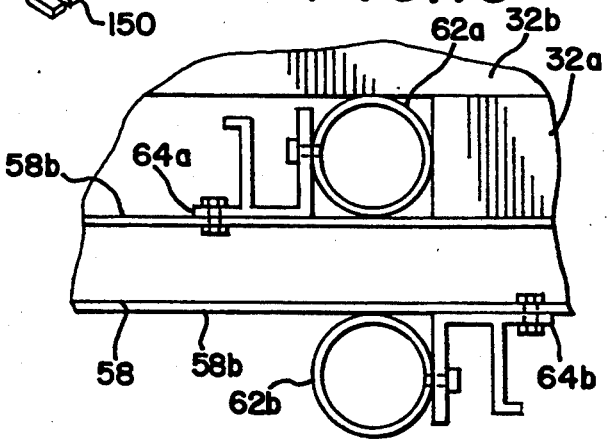
FIG. 10 is an enlarged fragmentary side elevational view of the sheet pushers mounted on the upper and lower reaches of the conveyor belt.

The conveyor 30 also includes a pair of sheet-engaging pushers 62*a* and 62*b* mounted on the outer surface 58*b* of the conveyor belt 58. As also illustrated in FIG. 10, the pushers 62*a* and 62*b* are positioned approximately one hundred eighty degrees apart from each other, wherein the pusher 62*a* is mounted on the top reach of the conveyor belt and pusher 62*b* is mounted on the bottom reach of the conveyor belt. Both pushers are attached to pusher brackets 64*a* and 64*b*, respectively, which in turn are secured to the outer surface 58*b* of the conveyor belt 58 by suitable fasteners. As the conveyor belt rotates, a pusher engages the end of the sheet of insulation 32 on the conveyor belt 58 and drives the sheet toward the central section 28 of the frame. The bracket provides support for the pusher as it engages the end of the sheet of insulation. Each pusher is made from circular aluminum tubing to provide a smooth rounded top surface for contacting the second lowest sheet 32*b*, stored in the magazine, as the lowest sheet 32*a* positioned on the conveyor belt is being driven by the pusher to the central section, as shown in FIG. 10. Accordingly, the diameter of the aluminum tube pusher should be greater than the height of the pusher bracket to prevent the top edge of the pusher bracket from scraping the second lowest sheet held in the magazine.

Figure 4:
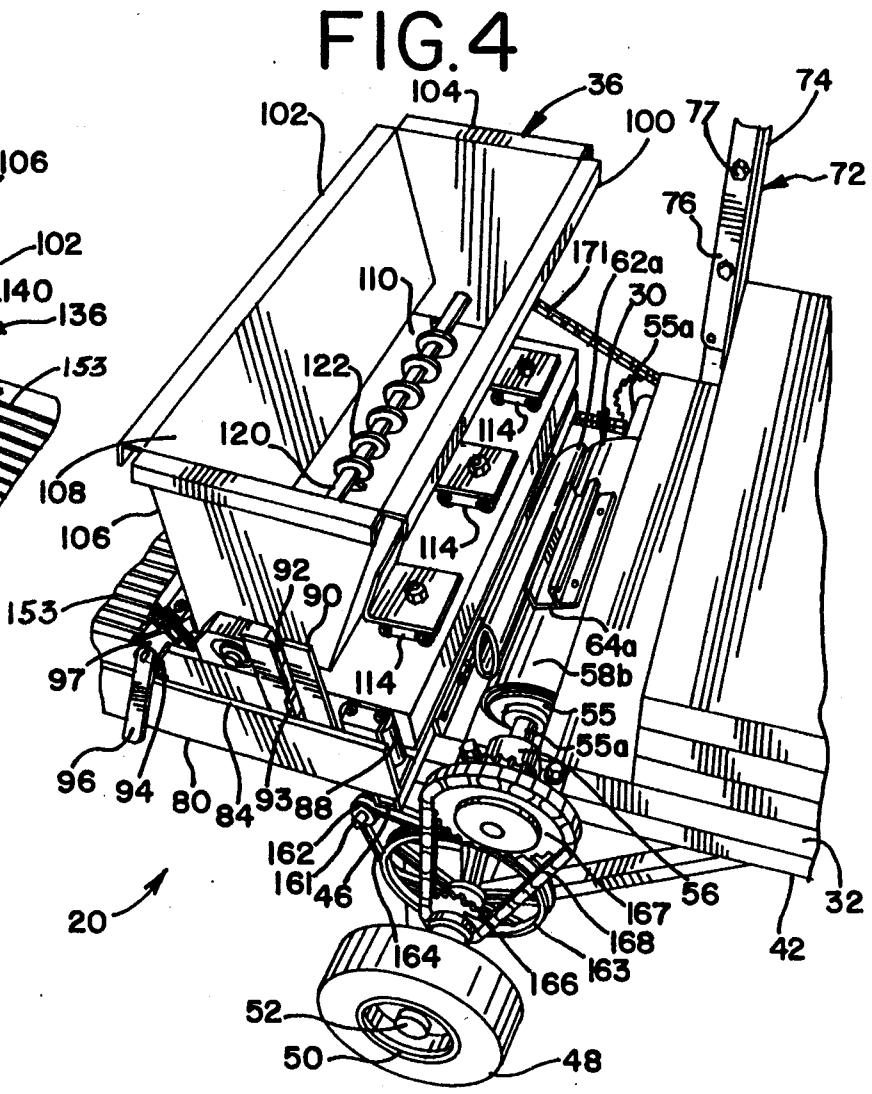
FIG. 4 is a fragmentary left side perspective view of the inlet and central sections of the adhesive applying apparatus, and specifically illustrating the inlet side of the hopper.
Figure 5:
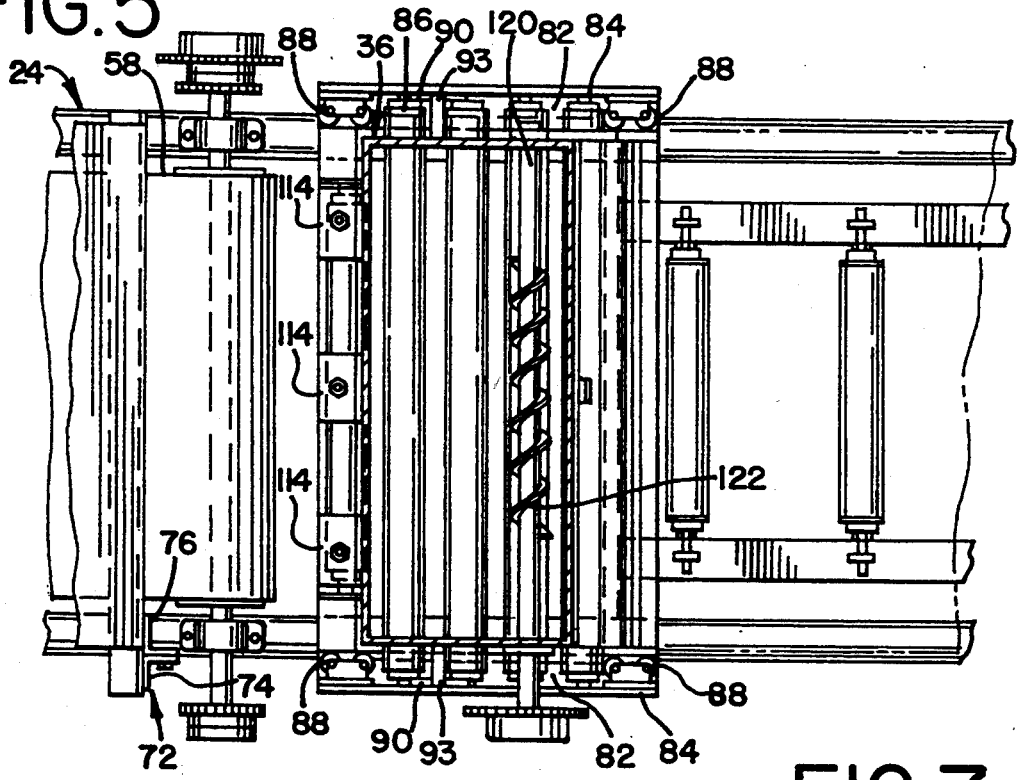
FIG. 5 is a fragmentary top plan view of the inlet, central, and outlet sections of the adhesive applying apparatus.
Figure 6:
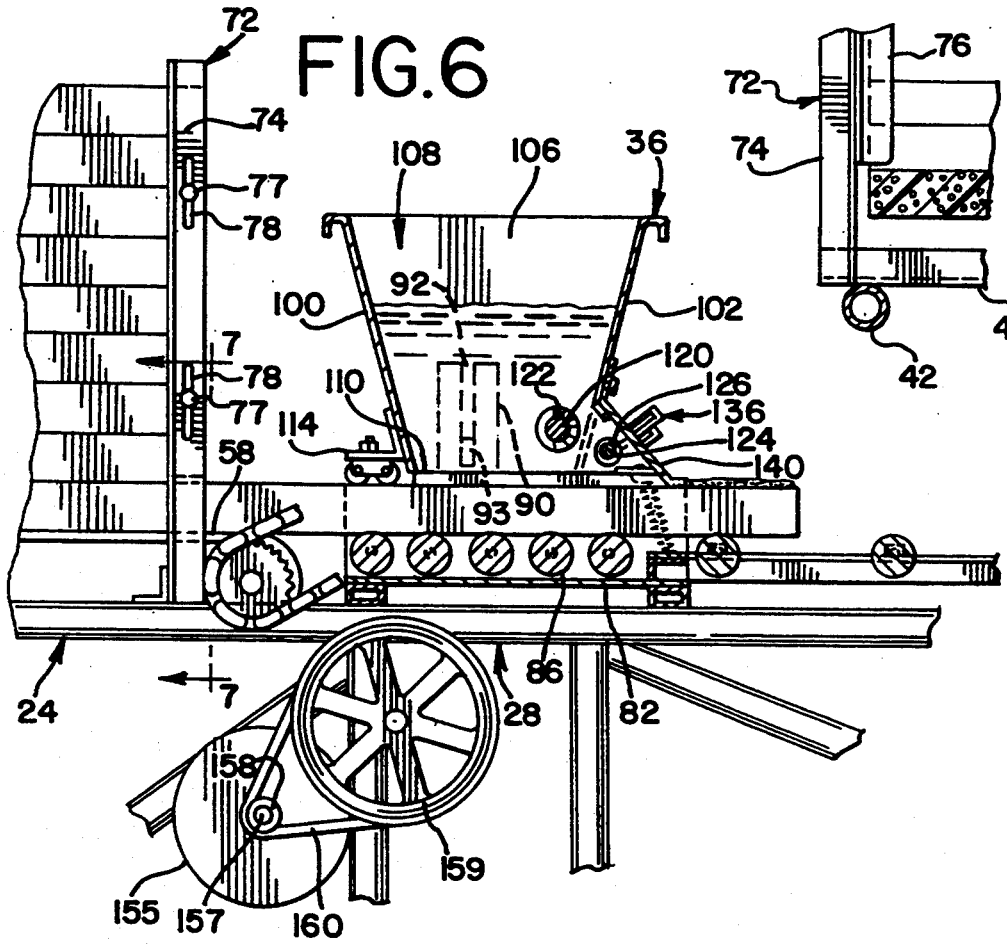
FIG. 6 is a fragmentary side elevational view of the inlet, central, and outlet sections of the adhesive applying apparatus illustrating the adhesive dispensing hopper in cross section.
Figure 7:
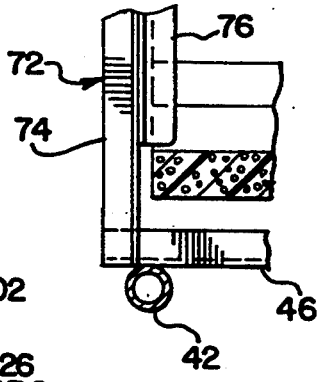
FIG. 7 is a fragmentary cross-sectional view of the inlet section taken substantially along line 7—7 of FIG. 6, and illustrating the retainer member of the magazine which controls the release of the sheets of insulation.

As also seen in FIGS. 4 to 6, there is sufficient clearance between the conveyor belt 58 on the inlet section 24 and the hopper 36 on the central section 28 such that after the pusher 62*a* fully drives the sheet to the central section, the conveyor belt rotates pusher 62*a* between the inlet and central sections from the top reach to the bottom reach. Simultaneously, the opposite pusher 62*b* rotates from the bottom reach to the top reach at the other end of the inlet section to engage the next sheet of insulation. It should be appreciated that once pusher 62*a* no longer engages the sheet under the hopper, that sheet stops moving toward the outlet section until the next sheet engaged by pusher 62*b* contacts the sheet under the hopper, end to end, and continues to drive that sheet from under the hopper. It should be also appreciated that the sheets of insulation could be driven from the inlet to the central section by alternative methods.

Figure 2:
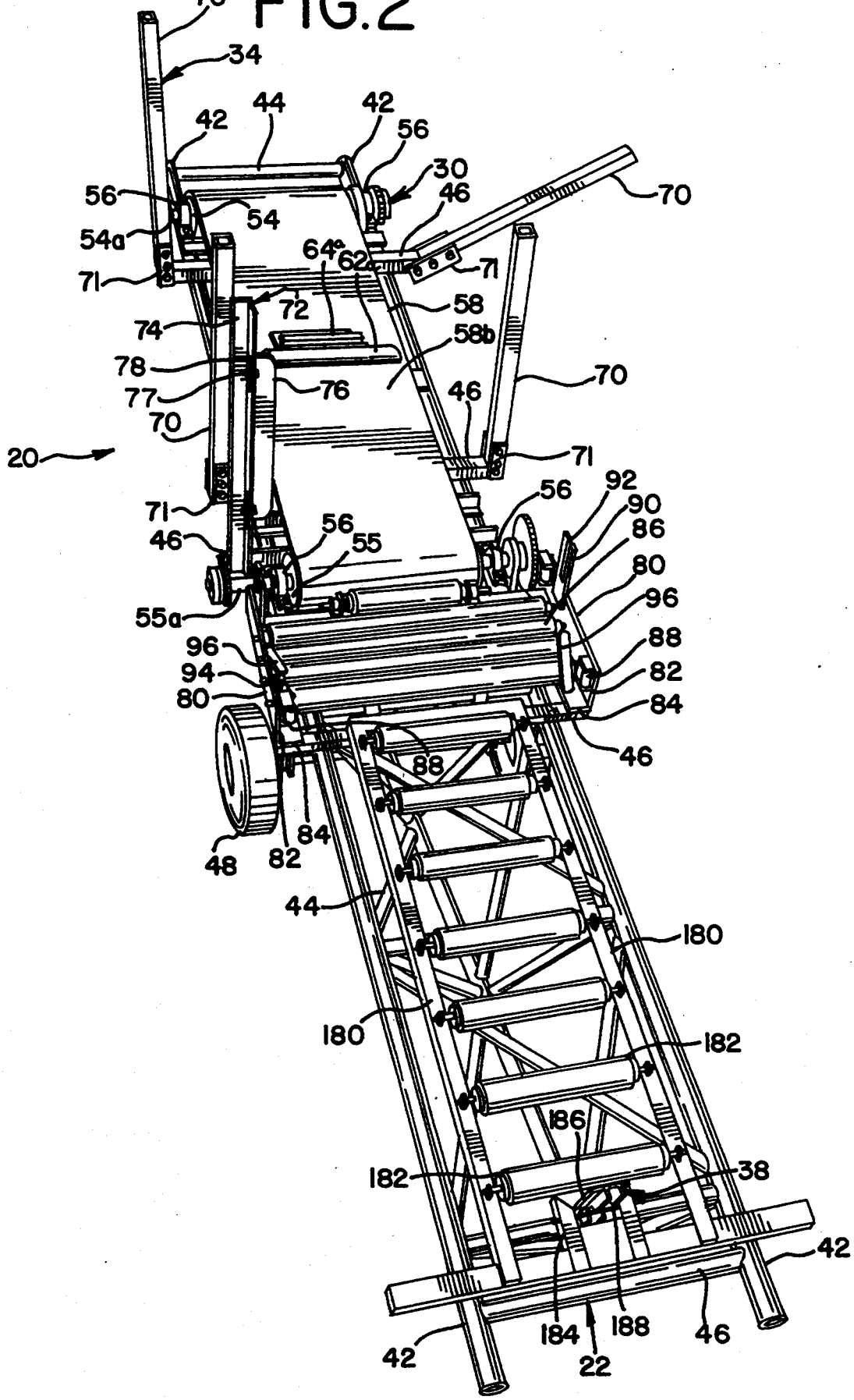
FIG. 2 is a top perspective view of the adhesive applying apparatus, and illustrated with the adhesive dispensing hopper removed for clarity purposes.

The magazine 34 for holding a plurality of sheets of insulation 32 and for dispensing the sheets of insulation, one at a time, onto the conveyor belt 58 is arranged over the conveyor belt, as shown in FIGS. 1 to 6. The magazine includes four posts 70 attached to the respective crossbars 46 of the inlet section 24. Attached to the lower end of each post is a suitable hinge 71 which enables the post to alternate between vertical and horizontal positions, as seen in FIG. 2, to facilitate the loading of numerous sheets of insulation into the magazine. The posts cooperate to hold the sheets of insulation in alignment above the conveyor as gravity pulls the lowermost sheet onto the conveyor belt 58.

All of the sheets of insulation in the magazine except for the lowermost sheet are maintained in the magazine by the magazine's sheet retainer 72, as illustrated in FIGS. 1 to 7. The sheet retainer 72 prevents all but the lowest sheet held in the magazine from being horizontally driven by the conveyor toward the center section. The sheet retainer 72 includes an L-shaped vertically extending bar 74 attached to a crossbar 46 and an L-shaped vertically extending stop 76 adjustably fastened to bar 74 at a height slightly greater than the thickness of the sheet of insulation to permit the lowest sheet to pass under the stop while preventing the other sheets from moving toward the central section. The stop 76 is fastened to the bar by a pair of bolts 77 which extend through apertures in the stop and suitably sized slots 78 in the bar to enable the stop 76 to be vertically adjusted relative to the bar 74 for accommodating sheets of insulation of varying thickness. The stop member may be adjustably fastened to the bar in any other known manner to allow for sheets of varying thickness. It should be appreciated that a sheet retainer could be attached to a bar on either side of the apparatus 20 or on both sides and that other suitable retainer members could be used in connection with the apparatus.

The central section of the frame, as illustrated in FIGS. 1 to 6, includes two crossbars 46 mounted perpendicularly on the supports 42 and a pair of L-shaped hopper mounting brackets 80 mounted perpendicularly on the crossbars 46 and parallel to the supports 42. Each hopper mounting bracket 80 has a horizontal flange 82 directly mounted to the crossbars 46 and an arm 84 extending perpendicular to the base. Suitable idle rollers 86 are mounted perpendicularly to and between the arms 84 of the brackets 80 at substantially the same height as the conveyor belt 58. These idle rollers facilitate the movement of the sheet of insulation as it is driven over the rollers and under the hopper 36. Thus, the rollers 86 support the insulation sheet and allow the sheet to be conveyed under the hopper and through the central section of the machine.

A pair of vertically arranged side guide rollers 88 are also attached to each arm 84 of each hopper mounting bracket 80 in a conventional manner. The side guide rollers 88 are vertically positioned to engage the side edges of the sheet of insulation as it is driven under the hopper 36 and between the arms of the mounting brackets. The side guide rollers assist in guiding the sheet of insulation between the two brackets while maintaining the sheet in alignment with the hopper 36.

Each hopper mounting bracket 80 further includes a guide plate 90 for receiving the hopper 36. The guide plate 90 is attached to and projects upwardly from the arm 84 of each bracket and has a vertical slot 92 adapted to guidably receive a guide bar 93 which projects horizontally from the adhesive hopper 36. Each bar is received in the slot 92 of the guide plate 90 for vertically positioning the hopper at the center section. Gravity causes the hopper to rest in the lowest position whereby the guide bars engage the bottoms of the respective U-shaped slots. As a sheet of insulation is driven under the hopper, this slot-guide bar construction enables the hopper to move upwardly or vertically float depending on the thickness of the sheet being fed under the hopper, as additionally illustrated in FIGS. 4, 6 and 8.

Figure 11:
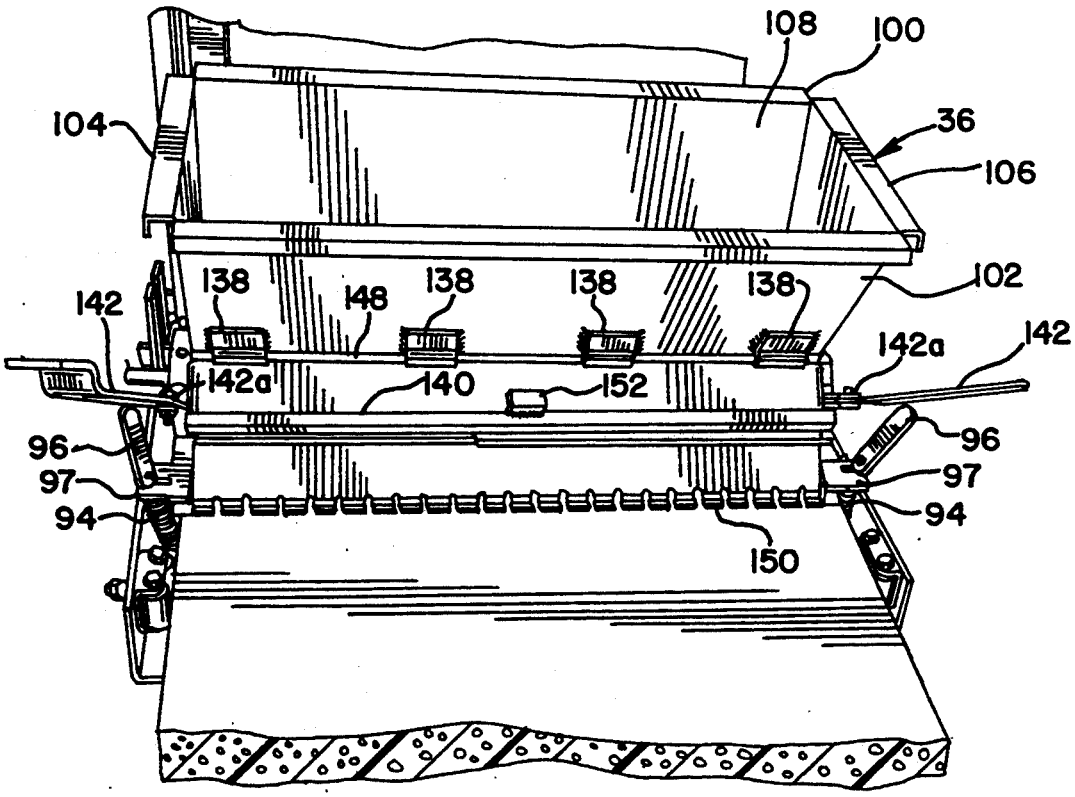
FIG. 11 is a perspective view of the outlet end of the hopper section, and illustrating the screed plate mounted on the hopper with the locking arms in unlocked position.
Figure 12:
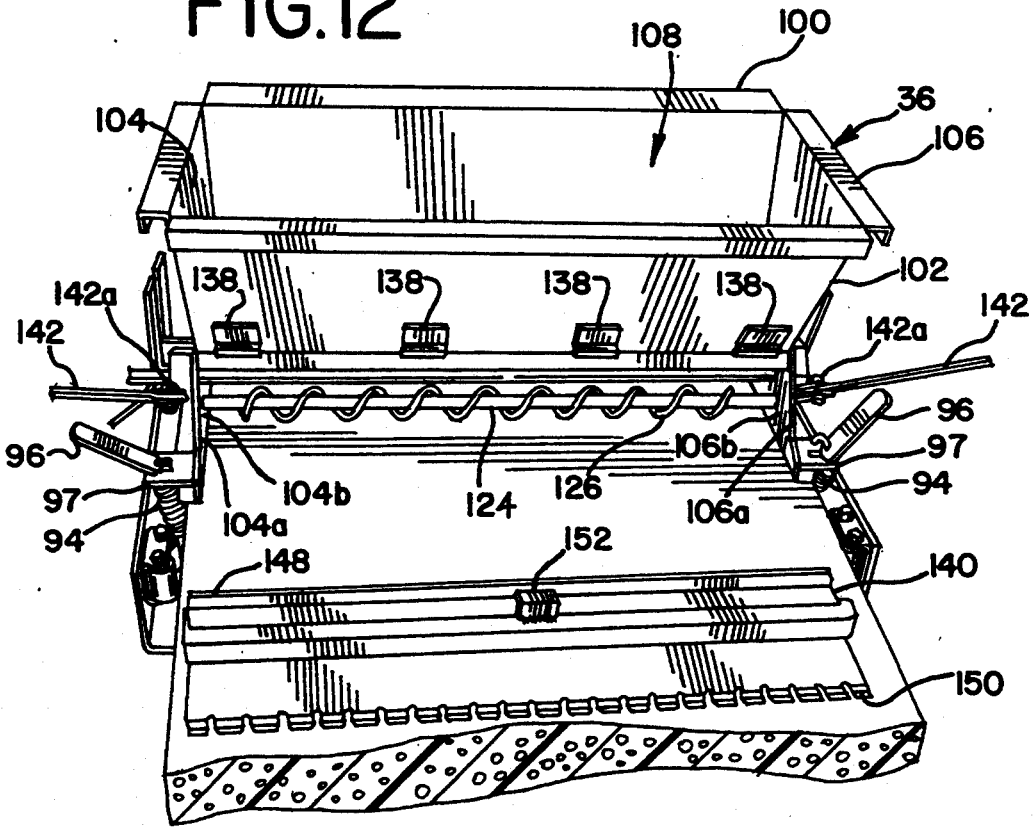
FIG. 12 is a perspective view of the outlet end of the hopper section, and illustrating the screed plate detached from the hopper.

The hopper is biased downwardly or toward the frame by two springs 94 which are fastened to the flanges 82 of the L-shaped mounting brackets. The end of each spring 94 is attached to a handle 96 for maneuvering the spring, and the spring is adapted to be received in a spring plate 97 which projects horizontally from the adhesive hopper 36. Each spring is securely received in a spring plate slot 98 of the spring plate to place vertical downward tension on the hopper as the sheet of insulation is fed under the hopper to further facilitate the floating of the hopper, as best seen in FIGS. 11 and 12.

The hopper 36 which is mounted on the central section of the frame 22 includes two spaced-apart downwardly converging inlet and outlet walls 100 and 102, connected by two spaced-apart opposed side walls 104 and 106, which define an adhesive storage area having upper and lower openings 108 and 110, respectively, the upper opening being larger than the lower opening. The inlet wall 100 of the hopper faces the inlet section 24 of the frame 22 and the outlet wall 102 faces the outlet section 26 of the frame. The hopper's lower opening 110 is substantially as wide as the standard sheet of insulation to facilitate the discharge or application of adhesive to the entire width of the sheet. Gravity will cause the adhesive which is placed in the hopper through the upper opening 108 to flow through the hopper to the lower opening 110 onto the entire width of the sheet of insulation as the sheet passes under the hopper.

It should be appreciated that the hopper may also include a suitably hinged top cover (not shown) for protecting and shading the adhesive stored in the hopper from sunlight, precipitation, and other contaminants or agents, thereby preventing the adhesive from drying due to heat or extended exposure or being diluted by precipitation. It should further be appreciated that the inside of the cover and the inside of the hopper could be lined with a suitable moisture-laden sheet for further protection of the adhesive stored in the hopper. The insulating material may be a water-absorbent presoaked sheet to provide moisture to the adhesive stored therein, especially in dry climates.

To facilitate the hopper's vertical floating capability, three sets of top guide rollers 114 are suitably connected to the inlet wall 100 of the hopper 36, as seen in FIGS. 1, 4 to 6, and 8. The top guide rollers are secured to the inlet wall in alignment with the lower opening 110 of the hopper. The horizontally positioned top guide rollers 114 engage the top surface of the sheet of insulation 32 to control the vertical height or floating position of the hopper according to the thickness of each sheet as the sheet is driven under the hopper.

The hopper 36 includes a power-driven mixing shaft 120 which is rotatably mounted longitudinally through the center of the lower part of the hopper and perpendicular to the side walls, as illustrated in FIGS. 4 to 6 and 8. The mixing shaft 120 is provided with an auger 122 for mixing the adhesive stored in the hopper 36. Suitable paddles or other known mixing tools may be substituted for the auger 122 to mix the adhesive. The mixing shaft 120 is rotated in coordination with the rotation of the conveyor, as described below.

The hopper 36 additionally includes a stationary shaft 124 mounted in the hopper below the mixing shaft 120 and closer to the outlet wall 102. The stationary shaft 124 lies substantially parallel to the mixing shaft 120 and includes a coil 126 which freely rotates on the shaft 124. The coil 126 functions to smooth the adhesive on the sheet of insulation 32 to prevent adhesive buildup on the sheet of insulation prior to the screeding function. The freely rotating coil 126 assists in mixing the adhesive and helps to prevent excess adhesive from accumulating inside the hopper at the outlet wall.

Figure 9:
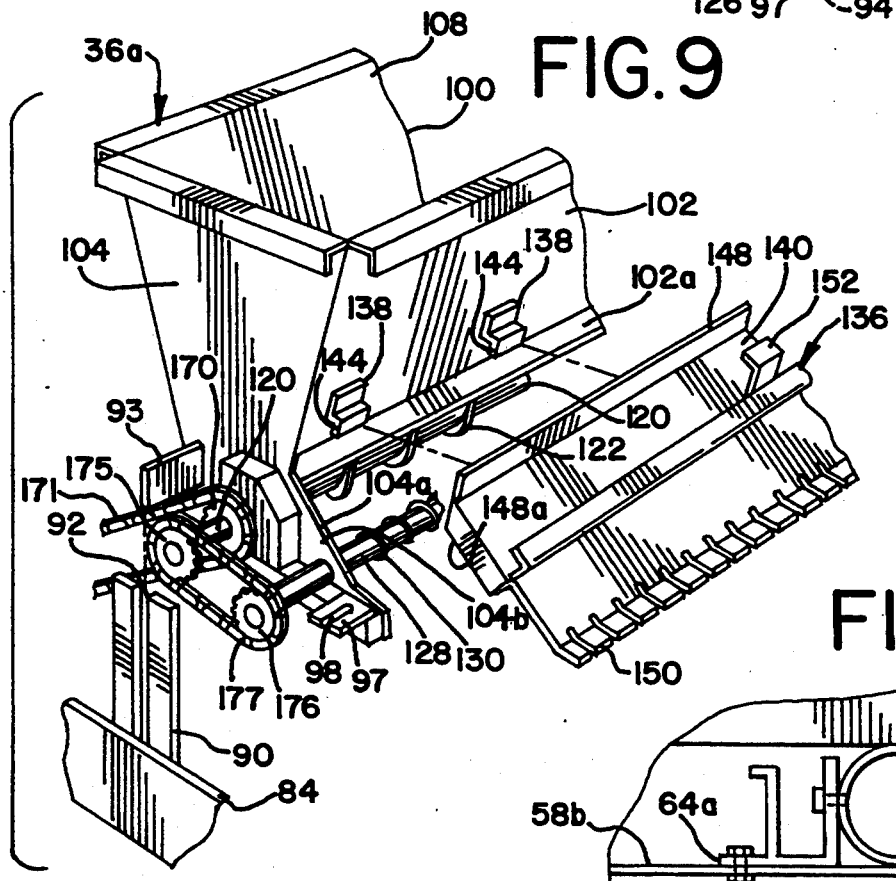
FIG. 9 is a perspective view of a modified adhesive dispensing hopper illustrating the outlet side of the hopper, a second mixing shaft, and the screed assembly, wherein the locking arms and supports therefor have been omitted for purposes of clarity.

A modified adhesive dispensing hopper **36*a* is illustrated in FIG. 9. In the modified hopper 36*a*, a second power-driven mixing shaft 128 is substituted for the stationary shaft 124. Similar to the mixing shaft 120, shaft 128 is fitted with an auger 130 for mixing the adhesive stored in the hopper or may be fitted with other suitable mixing tools. This mixing shaft 128 is rotatably driven in coordination with the rotation of the mixing shaft 120 and the conveyor 30**, as described below.

Figure 8:
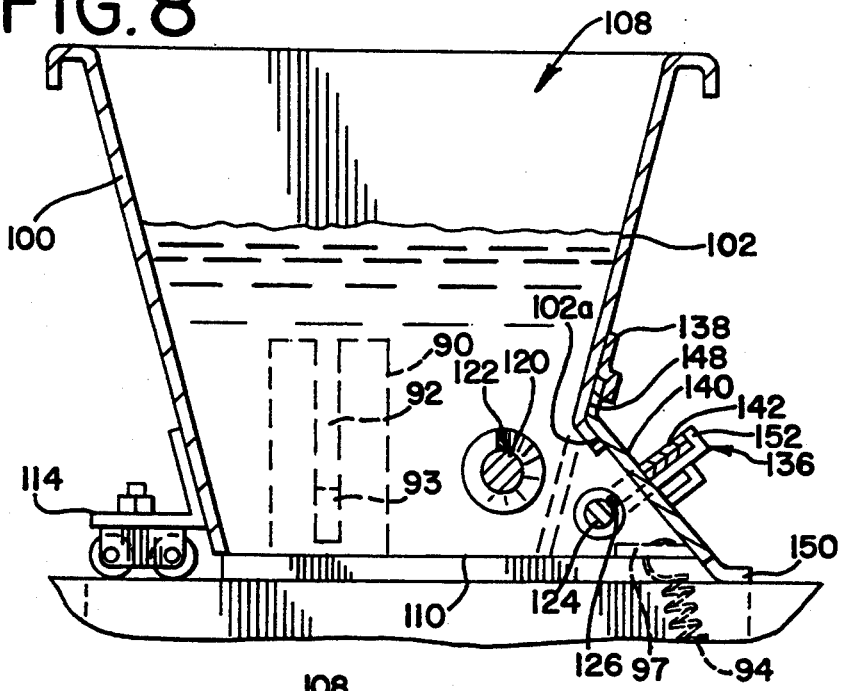
FIG. 8 is an enlarged cross-sectional view of the adhesive dispensing hopper taken substantially along line 8—8 of FIG. 3.

As best seen in FIGS. 3, 6, 8, 9, 11 and 12, a screed assembly is provided at the outlet side of the hopper 36 and along the lower end of outlet wall 102 to screed the adhesive onto the insulation sheets. This assembly includes a removable screed 136 having a screed plate 140 slanting downwardly and forwardly in the direction of sheet movement and terminating in a slotted edge formed by a plurality of spaced-apart teeth 150. As seen in FIG. 8, the teeth generally parallel the sheets and path of sheet movement. The screed 136 is removably attached to the hopper to facilitate cleaning the hopper and screed after the apparatus has been operated. The upper edge of the screed plate 140 includes an upstanding locking flange 148 and opposed guide flanges **148*a* for properly positioning the screed prior to locking the screed in place on the hopper. The upper end of the screed plate 140 is positioned on a ledge 102*a* which projects forwardly from the lower end of the front or outlet wall 102. Further, the upper opposite sides of the screed plate 140 are supported on the upper edges 104*a* and 106*a* of wall extensions 104*b* and 106*b* of the opposed hopper side walls 104 and 106. These wall extensions 104*b* and 106*b* are generally triangular, although the lowermost end is formed so that the lowermost end of the screed plate fits between the wall portions at opposite sides. The opposed guide flanges 148*a* mate over the outside surfaces of the wall extensions 104*b* and 106*b*. The screed is tilted during mounting to place the locking flange 148 under the locking lugs 144 of the Z-shaped brackets 138 which are secured to the outlet wall 102. While four brackets 138 are illustrated, any number may be provided to properly secure the upper end of the screed plate to the hopper. When the screed is set onto the hopper, a pair of locking arms 142 hinged at 142*a* at opposite sides of the frame 22 are swung inward over the screed and latched in place under a latch 152** mounted centrally of the screed. The free ends of one of the locking arms is offset to define a handle 142*a* to assist in locking the arm in position under latch 152 after first placing the other arm in position under the latch. Thus, the screed can be easily removed for servicing the screed and hopper, and thereafter replaced for operation of the adhesive applicator.

Figure 3:
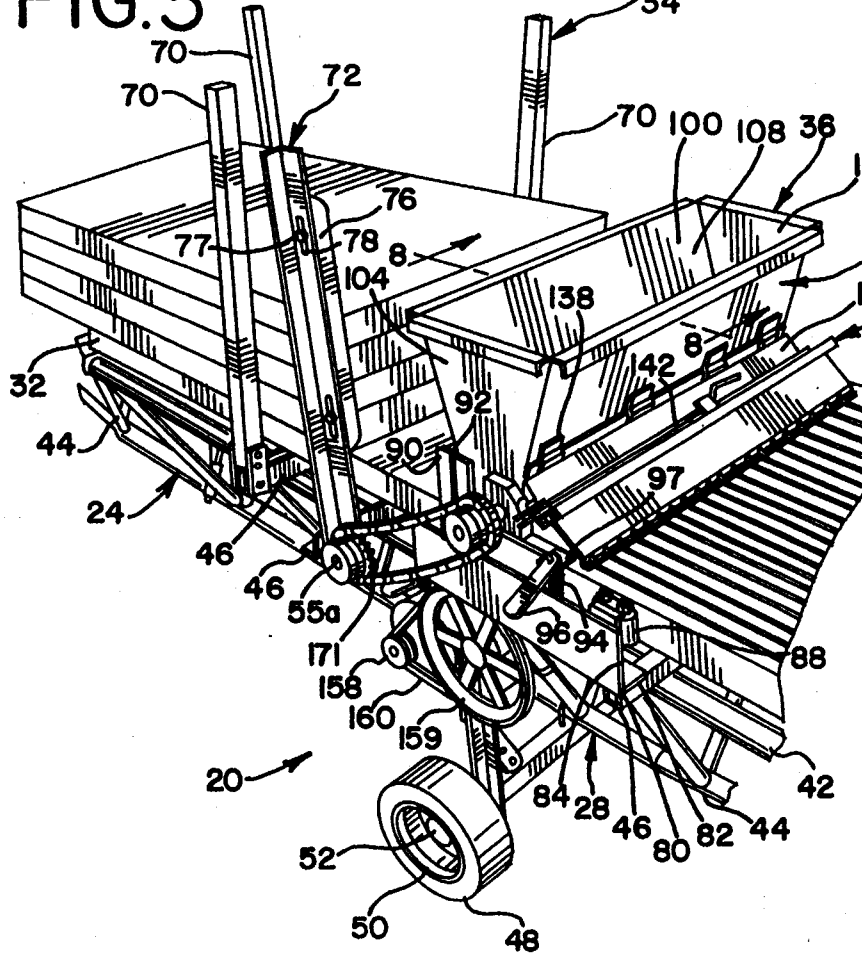
FIG. 3 is a fragmentary right side perspective view of the inlet and central sections of the adhesive applying apparatus, and specifically illustrating the outlet side of the hopper.

The teeth 150 along the lower end of the screed plate 140 are aligned with the hopper's lower opening 110 to engage the sheet of insulation 32 as the sheet passes under the hopper. The teeth define slots which extend upwardly to form beads of adhesive 153 uniformly along the entire length of the sheet, as seen in FIGS. 3 and 4. A rubber strip (not shown) may also be positioned across the bottom portion of the screed plate at the teeth and suitably held down at each end to the hopper extension walls 104*b* and 106*b* to provide a pressure adjustment of the screed against the insulation sheets.

Figure 13:
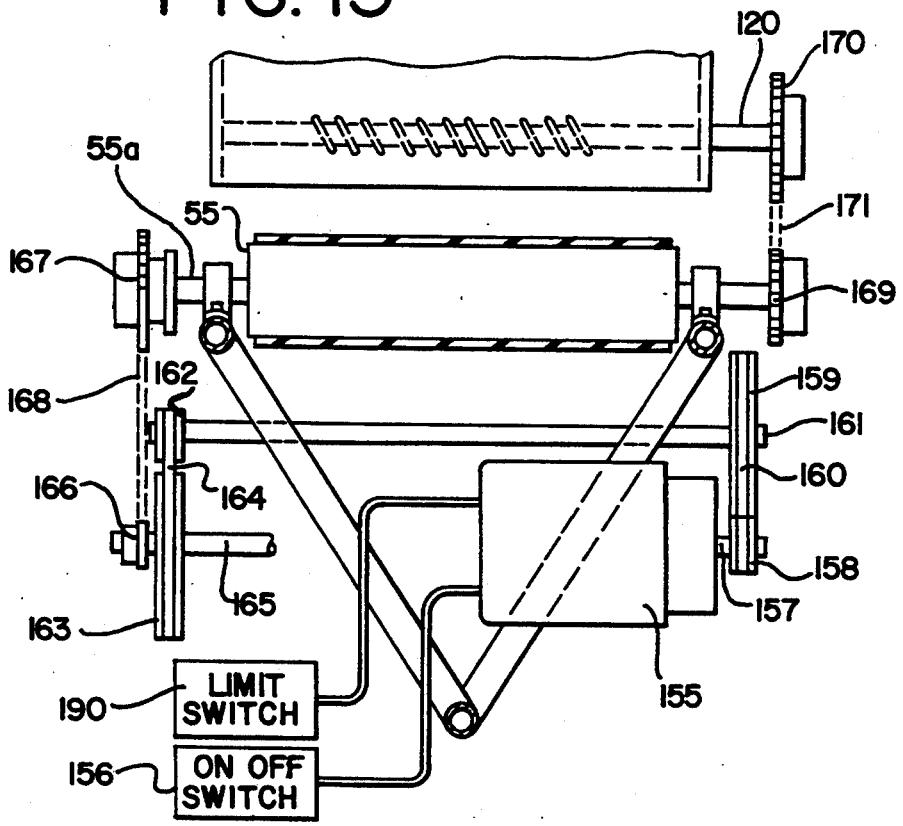
FIG. 13 is a schematic representation of the electric motor, the on-off switch, the limit switch, the conveyor drive system, and the mixing shaft drive system.
Figure 14:
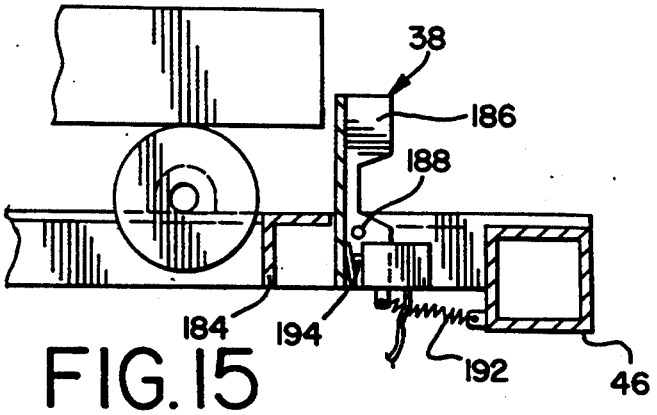
FIG. 14 is a fragmentary cross-sectional view of the outlet section of the adhesive applying apparatus, and illustrating a sheet of insulation approaching the stopping assembly.
Figure 15:
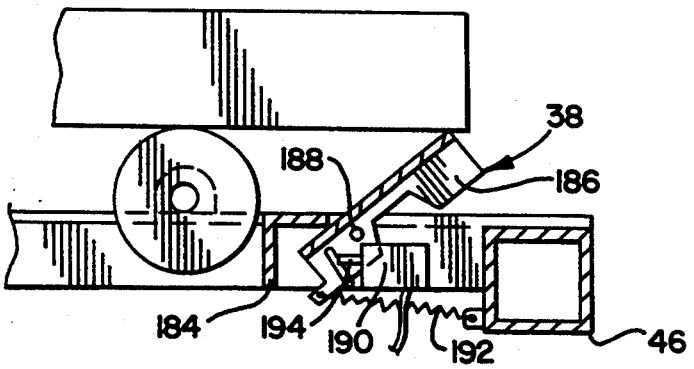
FIG. 15 is a fragmentary cross-sectional view of the outlet section of the adhesive applying apparatus, and illustrating a sheet of insulation actuating the stopping assembly.

The drive mechanism of the adhesive applying apparatus 20, as schematically illustrated in FIG. 13, includes an electric motor 155 mounted on the frame below the supports 42. The motor 155 includes a drive shaft 157. A main on/off switch 156 is provided for the motor. A first pulley 158 is mounted on the drive shaft and is in turn connected to a second pulley 159 by a suitable V-belt 160, as also seen in FIGS. 1, 3, 6 and 13. The second pulley 159 is mounted on a shaft 161 which is suitably mounted on the frame and extends across the frame. A third pulley 162 is mounted on the shaft 161 on the opposite side of the frame. The third pulley 162 is drivingly connected to a fourth pulley 163 by a V-belt 164, as also seen in FIGS. 4 and 13. The fourth pulley 163 is mounted on a shaft 165 which is freely rotatably mounted to the frame and which has mounted thereon a first sprocket 166. The first sprocket 166 is connected to a second sprocket 167 by a standard chain 168. The second sprocket 167 is mounted on the shaft 55*a* of the power-driven conveyor roller 55. Accordingly, when the electric motor is turned on, this drive assembly transfers the power of the motor to rotate the power-driven conveyor roller 55, thereby driving the conveyor belt 58. A third sprocket 169 is mounted on the opposite end of the shaft 55*a* and is drivably connected to a fourth sprocket 170 by an endless chain 171, as also seen in FIGS. 1 and 3. The fourth sprocket 170 is mounted on the hopper's mixing shaft 120. Hence, the mixing shaft 120 simultaneously rotates with the conveyor belt 120.

In the alternative embodiment of the hopper 36*a*, as illustrated in FIG. 9, the second mixing shaft 128 would rotate simultaneously with the conveyor and the first mixing shaft. In this embodiment, a fifth sprocket 175, attached on the first mixing shaft, is connected to a sixth sprocket 176 by an endless chain 177. The sixth sprocket 176 is mounted on mixing shaft 128 in a standard manner to facilitate the rotation of the second mixing shaft.

It should be appreciated that the motor, pulleys, belts, sprockets, and chains may be covered with suitable guards for safety purposes. It should also be appreciated that the electric motor could be replaced with a gas-powered motor or other suitable motors and that a gear box or speed reducer and brake could be substituted for the belt drive shown. For example, a suitable gear box such as the "OHIO GEAR SPEED REDUCERS" sold by Washington Belt & Drive Systems could suffice.

The outlet section 26 of the frame 22, as illustrated in FIGS. 1, 2 and 14 to 18, includes a pair of rails 180 mounted perpendicularly on the crossbars and substantially parallel to and between the supports 24. A series of idler rollers 182 are mounted perpendicularly on the rails at substantially the same horizontal level as the rollers of the central section and the conveyor to facilitate the horizontal movement of the sheet of insulation as it passes from central section. The idler rollers constitute a roller conveyer for conveying the sheets with adhesive to the outlet end for removal.

A sheet-stopping assembly 38 is provided beyond the rollers at the outlet end of the frame to stop the movement of each sheet of insulation once it passes from under the hopper filled with adhesive. The stopping assembly 38 includes a mounting bracket 184 mounted at the end of the frame, a lever 186 rotatably mounted on a pin 188 carried by the bracket 184, a limit switch 190 mounted on the bracket adjacent to and operable by the lever 186, and a spring 192 suitably mounted between the lever 186 and the bracket 184 for continually biasing the lever to an upright position. The lever is rotatable between a spring-biased open position which is a substantially perpendicular position to the horizontally extending frame and a closed position at an acute angle to the frame. As a sheet of insulation contacts and rotates the spring-biased lever 186, the lever moves from the open position to the closed position, thereby actuating a button or plunger 194 extending from the limit switch 190 in a conventional manner. The button triggers the limit switch 190 which to disconnect power to the electric motor, thereby stopping the conveyor, as schematically shown in FIG. 13. When the sheet is removed, the spring-biased lever returns to the open position, reactuating the button 194 which triggers the limit switch, thereby returning power to the motor and reactivating the conveyer.

It should be appreciated that the sheet-stopping assembly may be placed on the outlet section closer to the central section. If the stopping assembly is positioned closer to the central section, the conveyor will be deactivated before adhesive is applied to the entire length of the sheet of insulation. This may be useful during high wind conditions that would lift the sheet of insulation off the idler rollers. It should further be appreciated that the stopping mechanism may be attached on the outlet side so as to facilitate adjustment of the stopping assembly to various positions on the outlet section.

Figure 16:
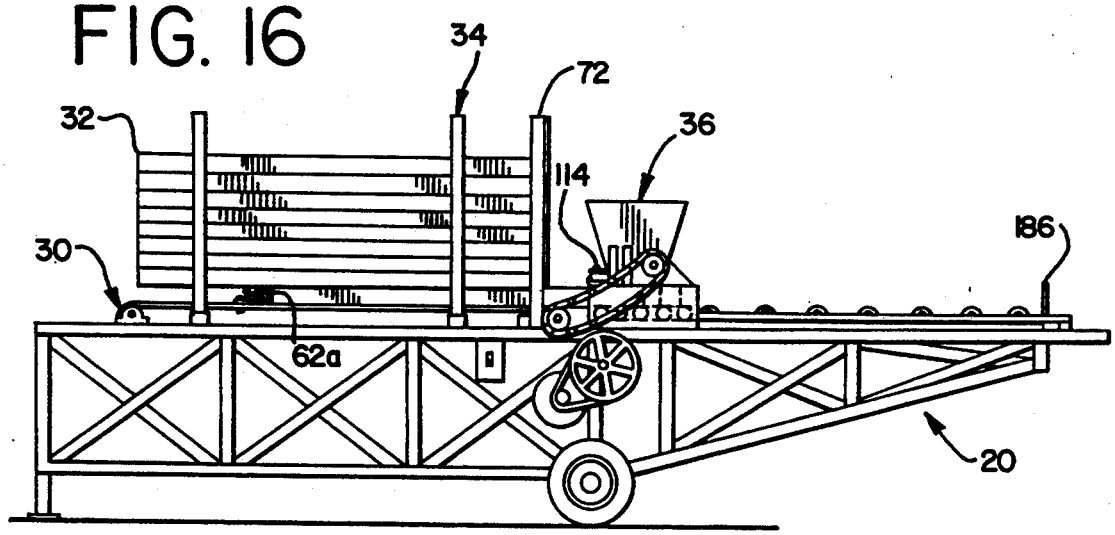
FIGS. 16, 17, and 18 are a series of diagrammatic side views illustrating the movement of a sheet of insulation from the magazine inlet section through the central section where the adhesive is applied and to the outlet section.
Figure 17:
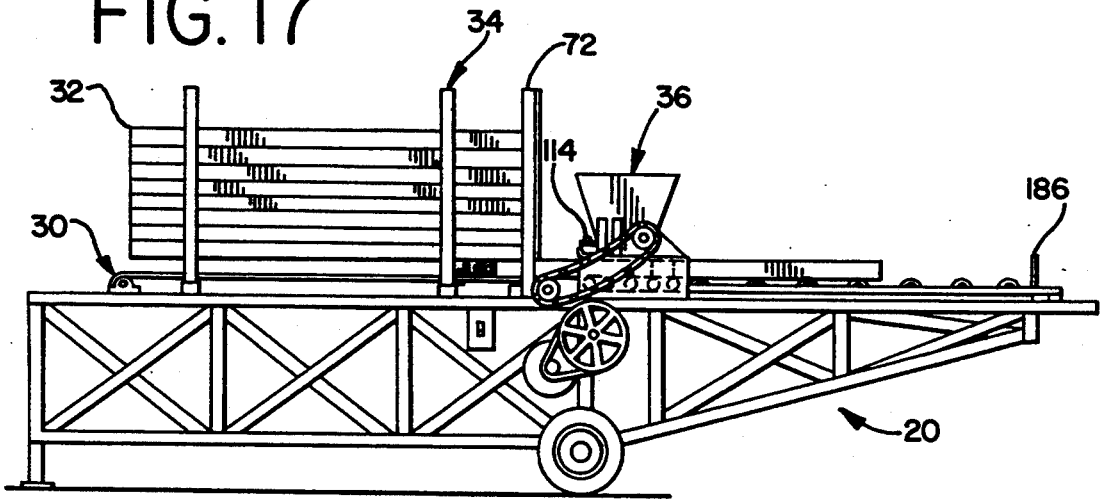
Figure 18:
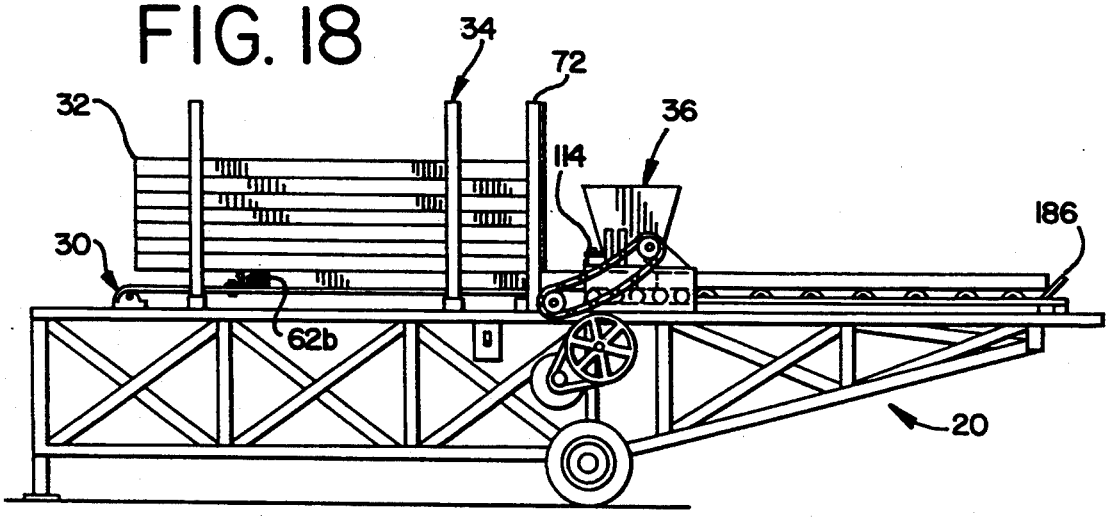

The method for sequentially applying a predetermined amount of adhesive to a series of sheets of insulation using the adhesive applying apparatus 20 of the present invention is further illustrated in FIGS. 16 to 18. To begin the adhesive-applying process, a plurality of sheets 32 of insulation are loaded into the magazine 34 arranged over the conveyer 30. If high winds are present, it may be necessary to place a suitable weight on the uppermost sheet of insulation stored in the magazine to maintain the sheets in the magazine because the sheets are light weight. When the sheets are loaded in the magazine, the lowest sheet (i.e., the first sheet) is initially dispensed onto the conveyor. The conveyor is turned on and the first sheet of insulation which is dispensed onto the conveyor belt is engaged by the pusher 62*a* to horizontally drive the sheet under the sheet retainer 72 toward the adhesive-dispensing hopper 36. As the sheet approaches the hopper, the top guide rollers 114 attached to the hopper 36 engage the top surface of the sheet and vertically position the hopper above the sheet. When the sheet of insulation fully covers the lower opening of the hopper, as in FIG. 16, the conveyor is shut off.

The hopper 36 is then filled with the appropriate adhesive and the conveyor is turned back on. It should be appreciated that if the hopper was filled with adhesive prior to moving the sheet under the hopper, the adhesive would freely flow onto the central section. The adhesive from the hopper is applied to the sheet of insulation as the rest of the sheet is driven by the conveyor under the hopper. The screed assembly on the outlet end of the hopper engages the top surface of the sheet to assure the uniform application of adhesive onto the sheet and prevent excess adhesive from remaining on the sheet as the sheet passes from underneath the hopper. As most or a substantial part of the sheet passes underneath the hopper, the next or second sheet of insulation is dispensed by the magazine onto the conveyor and is engaged by the opposite pusher **62*b* as in FIG. 18. This sheet is driven toward the hopper under the sheet retainer to contact the first sheet, end to end, which is no longer engaged by the conveyor belt or first pusher 62*a* but which has not been fully driven under the hopper. The second sheet driven by the conveyor and pusher pushes the first sheet from under the hopper, leaving no gap between the sheets for the adhesive stored in the hopper to flow. It should be appreciated that although FIG. 17** illustrates the sheets above the lowest sheet remaining in horizontal position, these sheets may fall toward the conveyor belt as the first sheet is driven toward the hopper.

When the first sheet reaches the lever 186 provided on the outlet section of the hopper, as shown in FIG. 18, the sheet rotates the lever from an open position to a closed position to trigger the limit switch which in turn deactivates or stops the conveyor from driving the second sheet under the hopper. This stops the movement of the second sheet of insulation and thus stops the movement of the first sheet. As the first sheet of insulation with the adhesive applied thereon is removed from the outlet side of the hopper, the lever 186 returns to the open position, triggering the limit switch which reactivates the conveyor. The conveyor then continues to drive the second sheet of insulation under the hopper. By continually repeating the process, adding adhesive and sheets as necessary, adhesive may be applied to numerous sheets of insulation which are loaded in the magazine for application of adhesive. The screed defines lines of adhesive on the sheets, as seen in FIG. 3.

Although not shown, the adhesive-applying apparatus may also include a cutting table positioned adjacent to or attached to the inlet end to cut sheets to a desired size for processing by the adhesive applying machine. This table will have supporting members for holding a sheet of insulation as well as a cutting apparatus. The cutting table and cutting apparatus may be of the type sold by Demand Products, Inc., or any other standard cutting table and cutting apparatus.

It will be understood that modifications and variations may be effected without departing from the scope of the novel concepts of the present invention, but it is understood that this application is to be limited only by the scope of the appended claims.

The invention is hereby claimed as follows:

1. An apparatus for sequentially applying adhesive to a series of sheets of insulation for securement of said sheets to a substrate, comprising an adhesive application means for applying adhesive to a surface of a sheet of insulation as said sheet is driven through said adhesive application means, said adhesive application means including a hopper for storing said adhesive, means mounting said hopper to float substantially vertically, means on said hopper to engage said surface of said sheet of insulation to automatically accommodate sheets of insulation of varying thickness during adhesive application, and a screed means carried by said hopper for uniformly screeding said adhesive applied on said surface of said sheet and for preventing excess adhesive from remaining on said sheet;

an inlet means for supportably driving said sheets of insulation one at a time through said adhesive application means, said inlet means including a conveyor means for engageably driving each said sheet of insulation and a magazine means for dispensing said sheets of insulation one at a time to said conveyor means;

an outlet means for supportably receiving said sheet of insulation driven through said adhesive application means as said adhesive is applied to said surface of said sheet of insulation, said outlet means including a stopping means for deactivating said conveyor means and preventing said inlet means from driving further sheets of insulation through the adhesive application means until said sheet of insulation with said adhesive applied thereon is removed from said outlet means.

2. The adhesive applying apparatus of claim 1, wherein said hopper further includes a first mixing means disposed in said hopper for mixing said adhesive stored in said hopper.

3. The adhesive applying apparatus of claim 2, wherein said hopper includes a shaft and coil means disposed in said hopper for preventing excessive amounts of adhesive from being applied to said sheet of insulation.

4. The adhesive applying apparatus of claim 2, wherein said hopper includes a second mixing means disposed below the first mixing means in said hopper for mixing the adhesive stored in said hopper.

5. The adhesive applying apparatus of claim 1, wherein said hopper includes two spaced-apart downwardly converging inlet and outlet walls connected by spaced-apart side walls defining upper and lower openings.

6. The adhesive applying apparatus of claim 5, wherein said hopper further includes a cover means.

7. The adhesive applying apparatus of claim 5, wherein said hopper is substantially as wide as said sheet of insulation.

8. The adhesive applying apparatus of claim 1, wherein said screed means is detachable from said hopper.

9. The adhesive applying apparatus of claim 1, wherein said screed means includes a series of spaced apart teeth.

10. The adhesive applying apparatus of claim 1, wherein said conveyor means includes a conveyor belt and a drive means for selectively rotating said conveyor belt.

11. The adhesive applying apparatus of claim 10, wherein said conveyor means includes at least one pusher means mounted on said conveyor belt for engaging an end of each sheet of insulation dispensed on the conveyor belt and driving said sheet from said inlet means through said adhesive application means.

12. The adhesive applying apparatus of claim 11, wherein said conveyor means includes a conveyor belt having two pusher means mounted on said belt for alternatively and continuously driving said sheets of insulation through said adhesive application means.

13. The adhesive applying apparatus of claim 1, wherein said magazine means includes a retainer means for retaining said sheets of insulation in said magazine means except for said sheet dispensed on said conveyor means.

14. The adhesive applying apparatus of claim 13, wherein said retainer means is adjustable.

15. The adhesive applying apparatus of claim 1, wherein said stopping means a includes a rotatable lever positioned adjacent to a limit switch, said lever having open and closed positions for alternatively triggering said limit switch through which said lever activates said inlet means in said open position and deactivates said inlet means in said closed position.

16. The adhesive applying apparatus of claim 1, wherein said adhesive applying apparatus further includes a tire and axle means for at least partially supporting the apparatus and to provide mobility to said apparatus.

17. The adhesive applying apparatus of claim 1, wherein said means mounting said hopper includes means for biasing said hopper and screed means downwardly against each sheet of insulation.

18. An apparatus for sequentially applying adhesive to a series of sheets of insulation for securement of said sheets to a substrate, comprising a frame having an inlet section, an outlet section, and a central section positioned between said inlet and outlet sections;

a conveyor mounted on said inlet section of said frame and adapted to drive a sheet of insulation to said central section, said conveyor having a drive means for selectively driving said conveyor;

a magazine means mounted on said inlet section of said frame above said conveyor for holding a plurality of stacked sheets of insulation, said magazine means having a retainer means for dispensing each sheet of insulation onto said conveyor;

an adhesive dispensing hopper mounted to float in a substantially vertical direction on said central section of said frame, said hopper being substantially as wide as said sheet of insulation, means on said hopper to engage said sheet of insulation to automatically accommodate sheets of insulation of varying thickness during adhesive application, and a screed means mounted on said hopper for uniformly applying a predetermined amount of adhesive to said sheet and for preventing excess adhesive from remaining on said sheet of insulation, and a receiving means mounted on said outlet section of said frame for receiving said sheet of insulation with adhesive applied thereon, said receiving means having a stop means having open and closed positions for alternatively activating said conveyor when in said open position and deactivating said conveyor when in said closed position.

19. The adhesive applying apparatus of claim 18, wherein said conveyor includes at least one pusher means mounted on said conveyor for engaging an end of said sheet of insulation dispensed on the conveyor and driving said sheet from said inlet section to said central section of said frame.

20. The adhesive applying apparatus of claim 18, wherein said conveyor includes a conveyor belt having two pusher means mounted on said belt for alternatively and continuously driving said sheets of insulation to said hopper.

21. The adhesive applying apparatus of claim 18, wherein said retainer means is adjustable for accommodating sheets of varying thickness.

22. The adhesive applying apparatus of claim 18, wherein said adhesive dispensing hopper includes spaced-apart downwardly converging inlet and outlet walls connected by spaced-apart side walls defining upper and lower openings.

23. The adhesive applying apparatus of claim 22, wherein said adhesive dispensing hopper further includes a first mixing means for mixing adhesive in the hopper.

24. The adhesive applying apparatus of claim 23, wherein said adhesive dispensing hopper includes a shaft and coil means for preventing excessive amounts of adhesive from being applied to said sheet of insulation.

25. The adhesive applying apparatus of claim 23, wherein said adhesive dispensing hopper includes a second mixing means disposed below the first mixing means in said hopper for mixing adhesive in said hopper.

26. The adhesive applying apparatus of claim 18, wherein said screed means is detachable from said adhesive dispensing hopper.

27. The adhesive applying apparatus of claim 18, wherein the stop means includes a stopping lever pivotally mounted on said outlet section of said frame and a limit switch mounted on the conveyor, wherein said stopping lever alternatively pivots between a spring biased open position and a closed position to trigger said limit switch to start and stop the conveyor.

28. The adhesive applying apparatus of claim 18, wherein said apparatus further includes a tire and axle means for supporting the apparatus and to provide mobility to said apparatus.

29. The adhesive applying apparatus of claim 18, wherein said hopper and central section includes means for biasing said hopper and screed means downwardly against each sheet of insulation.

* * * * *